United States Patent [19]

Lavoie

[11] Patent Number: 4,605,020

[45] Date of Patent: Aug. 12, 1986

[54] COMB

[76] Inventor: Michel Lavoie, 1875 Boulevard des Laurentides, Vimont, Laval, Canada, H7M 2P8

[21] Appl. No.: 716,630

[22] Filed: Mar. 27, 1985

[30] Foreign Application Priority Data

Feb. 19, 1985 [CA] Canada ..... 474663

[51] Int. Cl.[4] ..... A45D 24/00

[52] U.S. Cl. ..... 132/11 R; 132/150; D28/30

[58] Field of Search ..... 132/1 R, 11 R, 120, 132/124, 150, 45 R, 45 A; 15/167 R, 167 A, 160, 159 R, 159 A; D28/21, 22, 30

[56] References Cited

U.S. PATENT DOCUMENTS

| | | | |
|---|---|---|---|
| 1,035,411 | 8/1912 | Blunkall . | |
| 2,150,260 | 3/1939 | Berry . | |
| 2,154,120 | 4/1939 | Berliner | 132/150 |
| 2,551,472 | 5/1951 | Sonderegger . | |
| 2,568,898 | 9/1951 | Phillips et al. | 132/150 |
| 2,633,591 | 4/1953 | Servilla | 132/150 |
| 2,978,724 | 4/1961 | Gracian | 15/167 R |
| 3,010,459 | 11/1961 | Lerner | 132/45 R |
| 3,042,048 | 7/1962 | Mostik . | |
| 3,139,864 | 7/1965 | Makowsky | 15/167 R |
| 3,180,342 | 4/1965 | Dietsche . | |
| 3,214,776 | 11/1965 | Bercovitz | 15/167 R |
| 3,292,641 | 12/1966 | Quintanar | 132/45 R |
| 3,368,569 | 2/1968 | Lawrence | 132/124 |
| 3,916,918 | 11/1975 | Spinks | 132/11 R |

*Primary Examiner*—Robert P. Swiatek
*Assistant Examiner*—John G. Weiss
*Attorney, Agent, or Firm*—Robic, Robic & Associates

[57] ABSTRACT

A comb for use by a hairdresser during hair cutting. It has a combing portion and a handle portion which projects from one end of the combing portion, bends back toward the combing portion at a predetermined distance therefrom and includes a gripping part of predetermined length, suitable to be finger-gripped against the palm of a hand of the hairdresser with the combing portion located generally above the back of the hand.

5 Claims, 3 Drawing Figures

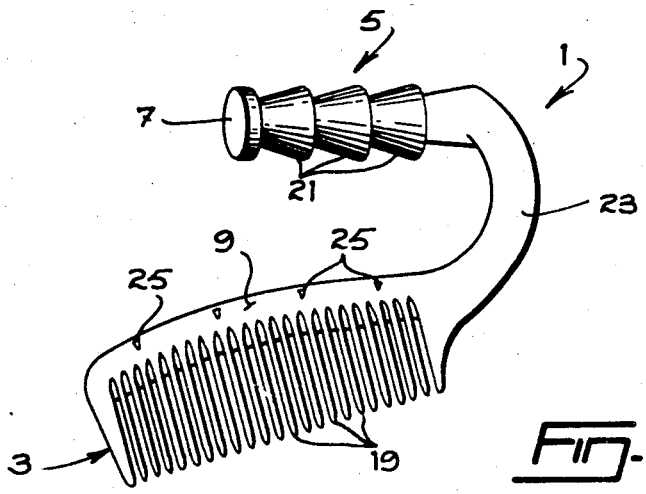
FIG. 1
FIG. 2
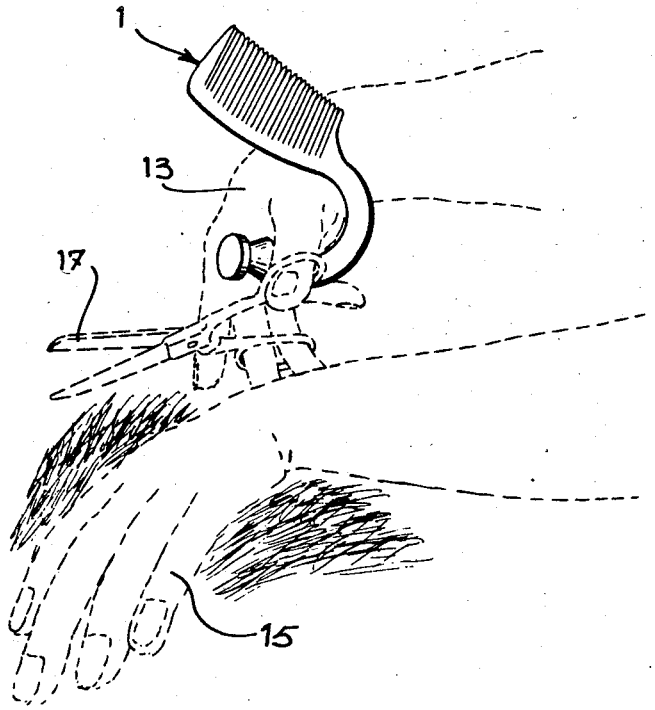

COMB

The present invention relates to a comb for use by hairdressers during the cutting of hair.

The present procedure in cutting hair consists, successively, in gathering hair into a tuft with a comb, holding the tuft with the fingers of one hand, laying the comb aside, gripping a pair of scissors with the other hand and cutting the hair of the tuft at the required length. The same successive steps are repeated time and again, for each tuft of hair, until the haircut is completed. It will be appreciated that the laying aside of the comb and the picking up of the scissors, for each tuft of hair, is quite a lengthy and tiresome procedure which, furthermore, may be distracting to the hair dresser particularly when the comb is accidentally dropped.

The object of the present invention lies in the provision of an improved comb, for use during hair cutting, which avoids the above inconvenience in that it can be held constantly by the same hand which likewise holds the scissors and this during the complete hair cutting process, thereby avoiding the tedious procedure mentioned above as well as doing away with any accidental dropping of the comb.

The above object is achieved, according to the invention as herein broadly claimed, with a comb which has a combing portion and a handle portion solid therewith, the handle portion projecting from one end of the combing portion, bending back toward the combing portion at a predetermined distance therefrom, and including a gripping part of predetermined length, the assembly being suitable for the gripping portion to be finger-gripped against the palm of a hand of the hairdresser with the combing portion then located generally above the back of the hand.

With the combing portion comprising the conventional base from which the combing teeth project, the comb of the invention preferably has its gripping part standing above the base with respect to the teeth. According to another preferred embodiment, the gripping part stands laterally of the base with respect to the teeth. Preferably, the handle gripping part is generally parallel with the base of the combing portion.

To prevent the comb from slipping in the hand, when gripped, the gripping part, which may be essentially round in cross-section, may be formed with knuckles spaced along the handle to define finger-lodging grooves.

The gripping part of the handle is preferably connected to the combing portion by means of an arcuate connection part and the base of the combing portion may suitably be provided with marks thereon adapted to divide the teeth into groups having an equal number of teeth.

A search has been made prior to the filing of this application, which search has revealed the following U.S. Pat. Nos.:

1,035,441—1912
2,150,260—1939
2,551,472—1951
3,042,048—1962
3,180,342—1965

Of the above, U.S. Pat. No. 2,150,260 provides a fingergrip comb wherein the portion gripped by the fingers extends laterally but in a straight line with the combing portion so that the comb may not be used conveniently by the same hand simultaneously with the scissors during the hair cutting operation. U.S Pat. No. 2,551,472 discloses a pocket comb which is one end of its base with a projection in the form of a short tongue directed at an acute angle toward the base of the comb and capable of being wedged between two fingers of a hand when the comb is in use. By reason of the shape and of the shortness of this tongue, the comb of this patent is entirely unsuitable for being held simultaneously with the scissors by one hand during hair cutting operation.

The remaining patents are of only a general interest and disclose devices which are completely devoid of the features mentioned above, more particularly a comb which, in use, has a gripping handle applied against the palm of a hand while the combing portion lies above the back of the hand. In other words, with the comb of the invention, the hand is inserted between the handle portion and the combing portion so that, with the handle being pressed against the palm of the hand by the short finger and the root of the thumb, this leaves the other fingers free to handle scissors to cut the hair so that there is no necessity to discard the comb when the hair is actually being cut.

An embodiment of the invention will now be described having reference to the appended drawing wherein:

FIG. 1 is a perspective view of a comb made the present invention;

FIG. 2 is a perspective view showing the use of the comb at the beginning of the hair cutting operation.

Figure 3:
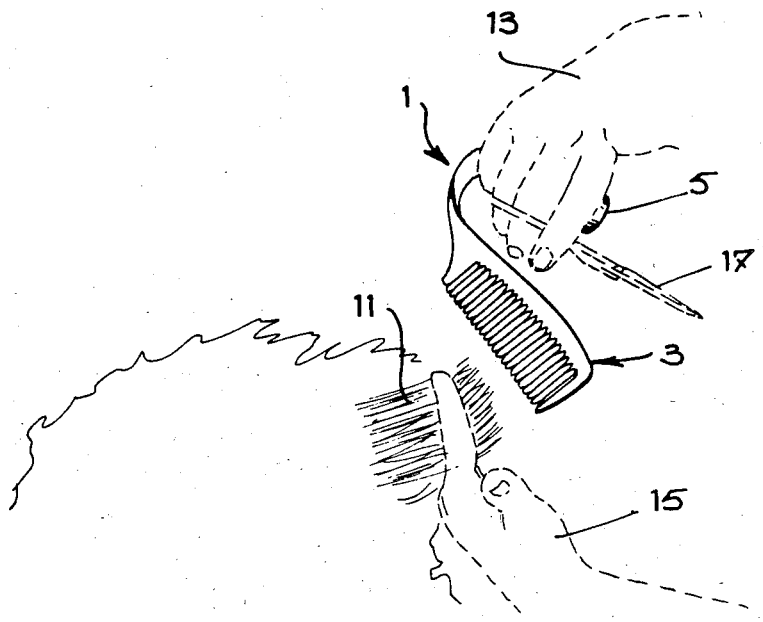
FIG. 3 is a perspective view of the comb shown still being gripped by the hand while the same hand is about to cut a tuft of hair.

As shown in FIG. 1, the comb 1 generally comprises a combing portion 3 and a handle portion 5 solid with the combing portion 3. The handle portion 5 projects from one end of the combing portion 3, bends back toward portion 3 at a predetermined distance therefrom, and includes a gripping part 7 having a predetermined length. As best shown in FIGS. 2 and 3, the gripping part 7 has a length sufficient for it to be firmly pressed against the palm of the hand while the distance between the same gripping part 7 and the base 9 of the combing portion 3 is quite sufficient to allow easy insertion of the fingers in between.

In use, and with particular reference to FIGS. 2 and 3, the hairdresser first selects a tuft of hair 11 with the comb 1 held in one hand 13, holds the tuft 11 between the forefinger and the second finger of the other hand 15 while removing the comb 1. The hand 13 is then slightly pivoted and the scissors 17, manipulated in the usual manner by the thumb, the second finger and the ring finger of the hand 13 that keeps holding the comb 1, proceeds to cut the tips of the hair projecting from the fingers of the hand 15. It will be appreciated that, all this time, there is no necessity to lay down the comb 1. Nor, in the succeeding operation, is it necessary to put the scissors aside. It will also be gathered that the time taken for cutting the hair is appreciably reduced and that the hairdresser is not distracted in any way and can keep his eyes constantly on the hair cutting operation.

Referring again back to FIG. 1, the combing portion 3 has a plurality of combing teeth 19 that project from the base 9 and the gripping part 7 of the handle portion 5 stands above the base 9 with respect to these teeth 19. Alternatively, the gripping part 7 may stand laterally of the base 9 with respect to the teeth 19. It will be seen also that the gripping part 7 is generally parallel to the base 9.

Additionally, the gripping part 7 of this embodiment is essentially round in cross-section and is formed with knuckles 21 which define therebetween grooves for the lodging of fingers to thus prevent the longitudinal displacement of the comb 1, in use.

The handle part 7, on the other hand, is joined at one end to the combing portion 3 through an arcuate connection part 23. Preferably, this connection part 23 tangentially connects with the base 9 of the combing portion 3 so that the gripping part 7 is located somewhat rearwardly of and above the base 9. This particular arrangement is found to make it easier to handle the combing portion 3.

The gripping part 7 of the handle portion 5 should advantageously extend at least over half the length of the base 9.

Again with reference to FIG. 1, the base 9 is provided with triangular marks 25 intended to divide the teeth 19 into groups having an equal number of teeth. These may be found useful in the selection of tufts of hair having the same width.

In a particular embodiment, the knuckles 21 may be oval with the long axes in a plane normal to the plane of the combing portion 3. Oval-shaped knuckles provide a firmer gripping action.

As best shown in FIG. 3, the combing portion is flat along the major portion but twists slightly out of its plane where it joins with the connecting part 23 which is also essentially flat. The gripping part 7 joins the upper end of the connecting part 23 at about right angles.

I claim:

1. A comb for use by a hairdresser during hair cutting, said comb comprising:

(a) a combing portion comprising a base and a plurality of combing teeth projecting therefrom; and (b) a handle portion solid with said combing portion, said handle portion comprising:

an arcuate connection part projecting from one end of the base of the combing portion tangentially therefrom and bending back toward said combing portion at a predetermined distance therefrom; and a gripping part integrally extending from the arcuate connection part in a direction generally parallel to the base of the combing portion, said gripping part standing above said base with respect to the combing teeth and having a predetermined length suitable to be finger-gripped against the palm of a hand of the hairdresser with the said combing portion located generally above the back of the hand, said gripping part being formed with knuckles that are spaced therealong and define finger-lodging grooves to prevent longitudinal displacement of the comb in use;

(c) wherein said predetermined distance at which the arcuate connection part is bent back toward the combing portion, is sufficient to allow easy insertion of the fingers between the gripping part of the handle portion and the base of the combing portion; and (d) wherein the combing portion is flat along the major portion of its length but twists slightly out of its plane close to the one end of its base from which projects the arcuate connecting part to give additional room to the fingers of the hairdresser.

2. A comb as claimed in claim 1, including marks on said base dividing said teeth into groups having an equal number of teeth.

3. A comb as claimed in claim 1, wherein said gripping part extends at least half the length of said base.

4. A comb as claimed in claim 3, wherein the arcuate connecting part of the handle portion is flattened in cross-section; and the gripping part of the handle extends from said arcuate connecting part at substantially right angle.

5. A comb as claimed in claim 4, wherein the knuckles spaced along the gripping part are oval in cross-section and have their long axes located in a plane normal to the plane of the combing portion.

* * * * *